US012604940B1

(12) United States Patent
Milan

(10) Patent No.: US 12,604,940 B1
(45) Date of Patent: Apr. 21, 2026

(54) HAT WITH MAGNETIC TOOL

(71) Applicant: Korie Milan, Menifee, CA (US)

(72) Inventor: Korie Milan, Menifee, CA (US)

( * ) Notice: Subject to any disclaimer, the term of this patent is extended or adjusted under 35 U.S.C. 154(b) by 0 days.

(21) Appl. No.: 19/223,745

(22) Filed: May 30, 2025

(51) Int. Cl.
*A42B 1/241* (2021.01)
*A42B 1/24* (2021.01)
*A42B 1/247* (2021.01)
*A42B 1/248* (2021.01)

(52) U.S. Cl.
CPC ..... *A42B 1/241* (2013.01); *A42B 1/24* (2013.01); *A42B 1/247* (2013.01); *A42B 1/248* (2013.01)

(58) Field of Classification Search
CPC ..... A42B 1/24; A42B 1/241; A42B 1/247; A42B 1/248
See application file for complete search history.

(56) References Cited

U.S. PATENT DOCUMENTS 1,623,768 A * 4/1927 Williams ..... A42B 1/24 43/57.1
4,586,280 A * 5/1986 Dane ..... G09F 19/00 40/406
5,107,548 A * 4/1992 Dotzenrod ..... A42B 1/008 2/209.13
5,111,366 A * 5/1992 Rife ..... F21L 2/00 2/209.13
5,253,368 A * 10/1993 Blake ..... B43K 29/00 40/329
5,267,494 A * 12/1993 Waluda ..... E05B 19/00 D8/40
5,548,847 A * 8/1996 Spicijaric ..... A42B 1/248 40/329
5,593,073 A * 1/1997 Finnegan ..... A44C 5/0007 224/267
5,704,070 A * 1/1998 Stogner ..... A42B 1/241 2/181.2
5,734,993 A * 4/1998 D'Oca ..... A42B 7/00 2/244
5,740,557 A * 4/1998 Reid ..... A42B 1/248 2/244
5,887,287 A * 3/1999 Potochnik ..... A42B 1/241 2/172
5,898,946 A * 5/1999 Keating ..... A63B 57/353 2/209.13
5,996,116 A * 12/1999 Tate ..... A63B 57/207 2/200.1
6,023,788 A * 2/2000 McCallum ..... A42B 1/241 2/209.13

(Continued)

*Primary Examiner* — Heather Mangine
(74) *Attorney, Agent, or Firm* — Fargo Patent & Business Law; Thomas Kading

(57) ABSTRACT

A hat assembly includes a cap having a front panel and a removable utility tool magnetically attachable to the front panel. The removable utility tool is formed of a metal material and may include features such as a bottle opener or a beer shotgun tool. The cap may further include an embedded magnet in the front panel, enabling secure, non-intrusive attachment of the tool, and may include a low-profile internal pocket for storage of small items. Additional features may include slots in the front and back panels configured to receive the temples of sunglasses or similar items. The assembly provides a versatile, practical, and visually appealing headwear solution integrating utility functions without compromising comfort or style.

8 Claims, 4 Drawing Sheets

(56) References Cited

U.S. PATENT DOCUMENTS 6,163,889 A * 12/2000 Tate ..... A63B 57/353 2/209.13
6,170,087 B1 * 1/2001 Brannon ..... G09F 21/02 2/209.13
6,170,088 B1 * 1/2001 Tate ..... A63B 57/35 2/200.1
6,175,963 B1 * 1/2001 Loeffelholz ..... A43B 23/24 2/200.1
6,240,568 B1 * 6/2001 Lee ..... A41D 27/08 40/329
6,477,714 B1 * 11/2002 Boatwright ..... A42B 1/24 2/209.13
6,966,851 B1 * 11/2005 England ..... A63B 57/353 2/209.13
D550,932 S * 9/2007 Cunliffe ..... D2/866
7,284,284 B2 * 10/2007 Wysopal ..... A42B 1/24 2/209.13
D571,539 S * 6/2008 Valcourt ..... D2/866
8,235,262 B1 * 8/2012 Sakdol ..... A42B 3/04 224/183
8,549,667 B1 * 10/2013 Fuller ..... A41D 27/20 2/160
8,695,457 B2 * 4/2014 Rozmus ..... B67B 7/16 30/450
D705,526 S * 5/2014 Clark ..... D2/866
D705,527 S * 5/2014 Clark ..... D2/866
8,757,030 B2 * 6/2014 Ochs ..... B67B 7/16 81/3.4
9,244,211 B2 * 1/2016 Campbell ..... A42B 1/242
10,272,577 B2 4/2019 Corner et al.
10,492,554 B2 12/2019 Sears
D876,755 S * 3/2020 Gonzalez ..... D2/866
2003/0024033 A1 * 2/2003 Viggiano ..... G02C 3/02 2/209.13
2005/0034210 A1 * 2/2005 Kronenberger ..... A42B 1/24 2/152.1
2005/0050613 A1 * 3/2005 Legg ..... A42B 1/24 2/209.13
2006/0031977 A1 * 2/2006 Wysopal ..... A42B 1/24 2/209.13
2007/0028361 A1 * 2/2007 Ashy ..... A42B 1/248 2/209.13
2007/0101480 A1 * 5/2007 Douglas ..... A42B 1/247 2/209.13
2007/0163028 A1 * 7/2007 Brauner ..... A42B 7/00 2/175.7
2007/0220656 A1 * 9/2007 Cotutsca ..... A42B 1/247 2/171
2007/0266477 A1 * 11/2007 Cunliffe ..... A42B 1/241 2/209.13
2007/0271679 A1 * 11/2007 Wysopal ..... A42B 1/24 2/209.13
2008/0116283 A1 * 5/2008 Newbrough ..... B67B 7/16 235/487
2008/0250544 A1 * 10/2008 Kim ..... A42B 1/248 2/195.1
2009/0205111 A1 * 8/2009 Beard ..... A47J 41/0066 220/592.16
2009/0255941 A1 * 10/2009 Kuntz ..... B65D 81/3879 220/592.17
2010/0122401 A1 * 5/2010 Thompson ..... A42B 1/24 2/243.1
2011/0048061 A1 * 3/2011 Beard ..... B67B 7/16 220/592.16
2011/0136555 A1 * 6/2011 Ramies ..... G06F 1/1626 455/575.8
2011/0314580 A1 * 12/2011 Vach ..... A42B 1/247 2/10
2013/0334237 A1 * 12/2013 Priest ..... B65D 23/12 220/739
2016/0007667 A1 * 1/2016 Morrow ..... A42B 1/0182 2/195.1
2017/0027263 A1 * 2/2017 Yurevich ..... A42B 1/247
2017/0086527 A1 * 3/2017 Corner ..... B26B 11/00
2017/0164676 A1 * 6/2017 Henrickson ..... A42B 1/24
2017/0245572 A1 * 8/2017 Han ..... A63H 33/086
2018/0140033 A1 * 5/2018 Thornton ..... A42B 1/0182
2018/0177257 A1 * 6/2018 Sears ..... A42B 1/248
2018/0199650 A1 * 7/2018 Kim ..... A63B 57/10
2018/0206573 A1 * 7/2018 Hall ..... A42B 1/24
2018/0206575 A1 * 7/2018 Dotzenrod ..... A47G 23/0266
2019/0075875 A1 * 3/2019 Lacy ..... A42B 1/22
2019/0174856 A1 * 6/2019 Bowles ..... A42B 1/24
2019/0353463 A1 * 11/2019 Saad ..... A42B 1/205
2019/0375087 A1 * 12/2019 Liang ..... A45C 1/06
2020/0095107 A1 * 3/2020 Niebergall ..... B67B 7/24
2020/0146377 A1 * 5/2020 McCarty ..... A63B 57/00
2020/0159039 A1 * 5/2020 Masters ..... A42B 1/247
2020/0297057 A1 * 9/2020 Davis ..... A42B 1/0184
2021/0177080 A1 * 6/2021 White ..... A42B 1/248
2021/0177082 A1 * 6/2021 Watson, Jr. ..... A42B 1/247
2021/0219645 A1 * 7/2021 Taylor ..... A42B 1/004
2021/0259346 A1 * 8/2021 Hodgdon ..... A42B 1/22
2021/0308542 A1 * 10/2021 Parra ..... A63B 57/207
2022/0007868 A1 * 1/2022 DeMatteo ..... A47G 23/02
2022/0039500 A1 * 2/2022 McEvoy ..... A42B 1/248
2022/0297994 A1 * 9/2022 Willerton ..... B67B 7/16
2023/0009979 A1 * 1/2023 Briggs ..... F25D 3/08
2023/0263254 A1 * 8/2023 Böck ..... A41D 27/08 2/246
2025/0160297 A1 * 5/2025 Bittman ..... A01K 13/006

* cited by examiner

HAT WITH MAGNETIC TOOL

CROSS REFERENCE TO RELATED APPLICATION[S]

None

BACKGROUND

The present disclosure relates to a hat, and more specifically to a hat with a magnetic multipurpose tool.

Conventional hats are typically used for protection from sunlight, weather elements, and for fashion or promotional purposes. While some hats include added features such as built-in lights or compartments, they often tend to be bulky, unattractive, or difficult to use. Conventional hats lack securely integrated, visually appealing, and practical utility tools that can assist the wearer in practical tasks.

This background section is intended to introduce the reader to various aspects of art that may be related to various aspects of the present disclosure, which are described and/or claimed below. This discussion is believed to assist the reader with background information to facilitate a better understanding of the various aspects of the present disclosure. Accordingly, it should be understood that these statements are to be read in this light, and not as admissions of prior art.

SUMMARY

A hat with a magnetic tool according to one disclosed non-limiting embodiment of the present disclosure includes a hat assembly with a cap having a front panel and a magnetically attachable removable utility tool.

A further embodiment of any of the foregoing embodiments of the present disclosure wherein the removable utility tool functions as a bottle opener.

A further embodiment of any of the foregoing embodiments of the present disclosure wherein the removable utility tool functions as a beer shotgun tool.

A further embodiment of any of the foregoing embodiments of the present disclosure wherein the hat is a baseball hat.

A further embodiment of any of the foregoing embodiments of the present disclosure wherein the removable utility tool is a curved rectangular metallic component.

A further embodiment of any of the foregoing embodiments of the present disclosure wherein the removable utility tool has a visible face with a design.

A further embodiment of any of the foregoing embodiments of the present disclosure wherein the cap includes a fabric-encased magnet that attaches to the rear face of the utility tool.

A further embodiment of any of the foregoing embodiments of the present disclosure that includes a pair of slots in the front panel and a pair of slots in a back panel of the cap arranged along parallel axes.

A further embodiment of any of the foregoing embodiments of the present disclosure wherein the front panel contains a magnet.

A further embodiment of any of the foregoing embodiments of the present disclosure wherein front panel has an interior pocket.

A baseball hat assembly with a front panel and an encased magnet in the front panel.

A further embodiment of any of the foregoing embodiments of the present disclosure that includes a removable utility tool shaped to match the front panel and is magnetically attachable to the front panel.

A further embodiment of any of the foregoing embodiments of the present disclosure that includes parallel slots in the front panel and rear panel of the baseball hat.

A further embodiment of any of the foregoing embodiments of the present disclosure that includes a pocket in the interior of the front panel.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
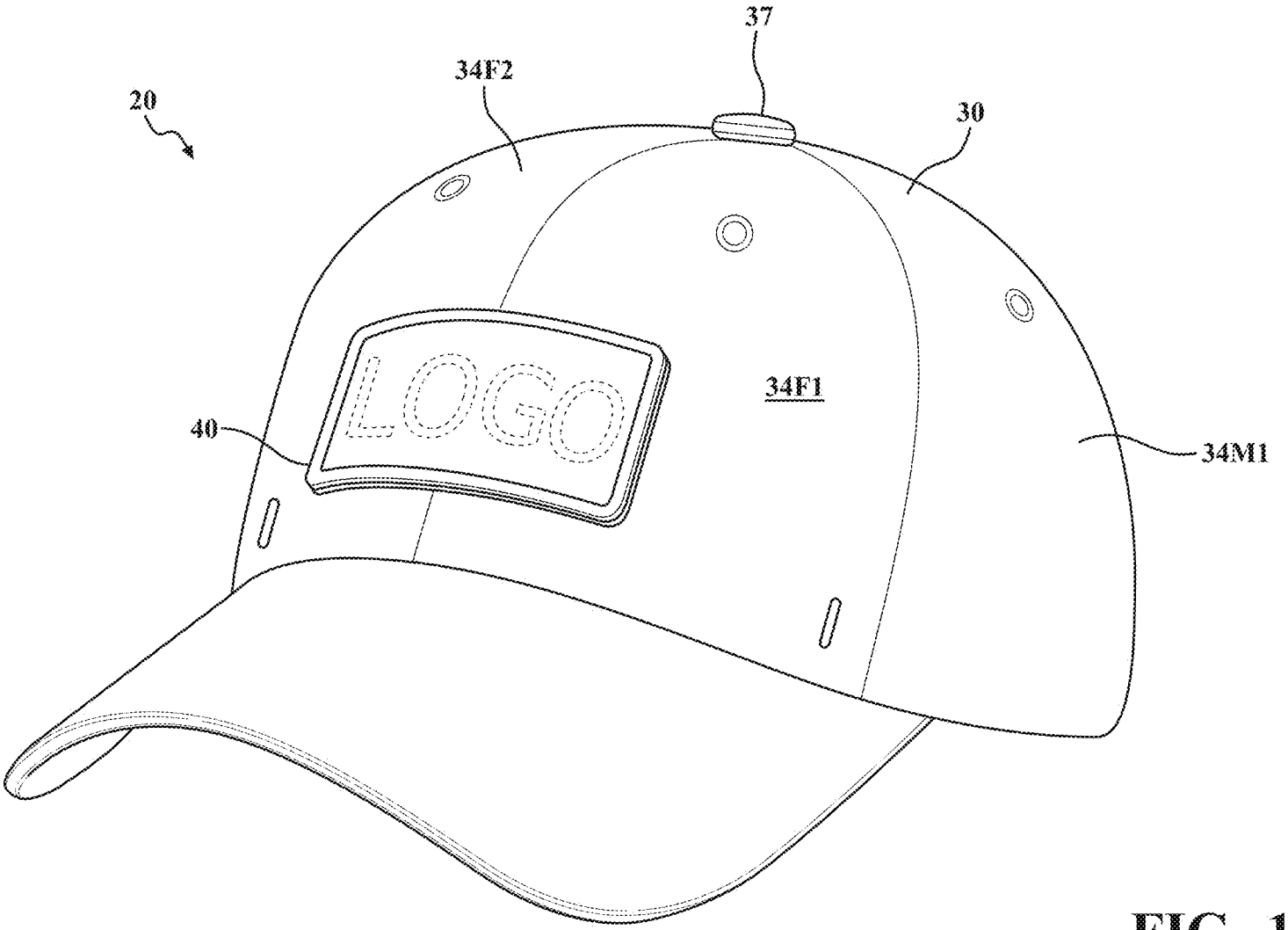
FIG. 1 is a perspective view of a hat assembly according to one disclosed non-limiting embodiment.

FIG. 1 schematically illustrates a hat assembly 20 that includes a cap 30 that supports a removable utility tool 40. In one embodiment, the hat is a baseball type hat that typically includes a visor 32 adjacent to a first and second front panel 34F1, 34F2. Other embodiments may include cowboy hats, bucket hats, beanies, five-panel hats, trucker hats, and similar headwear.

Figure 2:
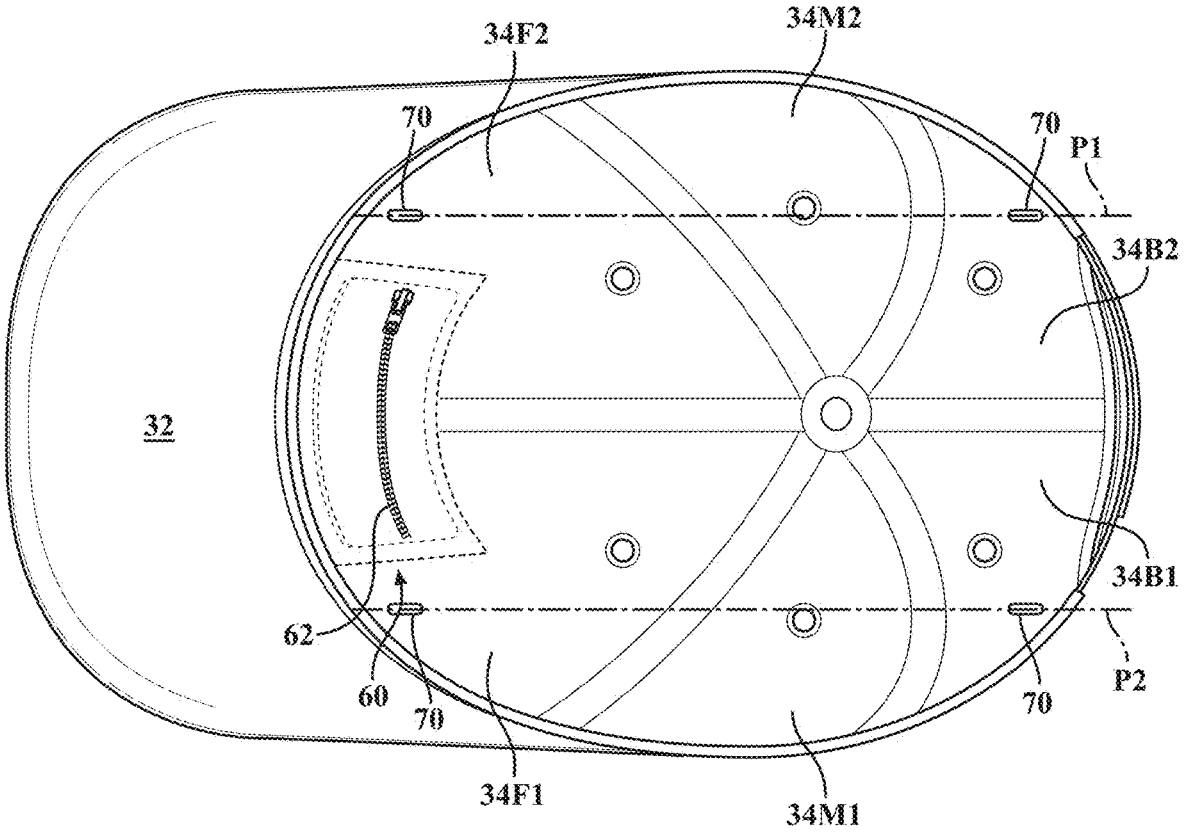
FIG. 2 is a bottom view of a hat assembly according to one disclosed non-limiting embodiment.
Figure 3:
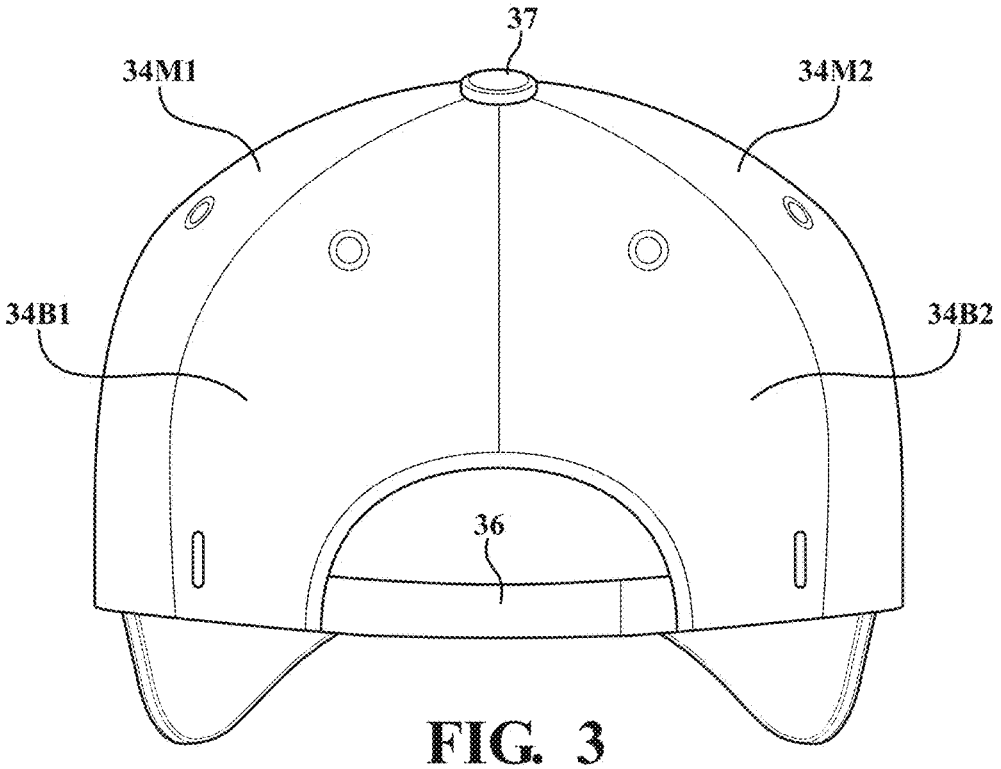
FIG. 3 is a rear view of a hat assembly according to one disclosed non-limiting embodiment.

The visor 32 is the stiff front part of the cap 30 that extends outward to protect the face from sunlight. The visor 32 is typically made from plastic and is sewn into the fabric of the cap 30 that is formed of a multiple of panels 34F1, 34F2, 34M1, 34M2, 34B1, 34B2 (FIG. 2). The panels 34 are individual sections of fabric that make up the crown of the cap, usually five or six in total. These panels are stitched together to form the overall shape with a closure 36 (FIG. 3) at the back of adjustable hats that allow for size adjustments. Common types include plastic snaps, hook and loop, and leather straps. The multiple of panels 34F1, 34F2, 34M1, 34M2, 34B1, 34B2 typically all meet at button 37 located at the top of the hat. The buttons are typically manufactured of a metal covered by a matching or complimentary colored fabric.

Figure 4:
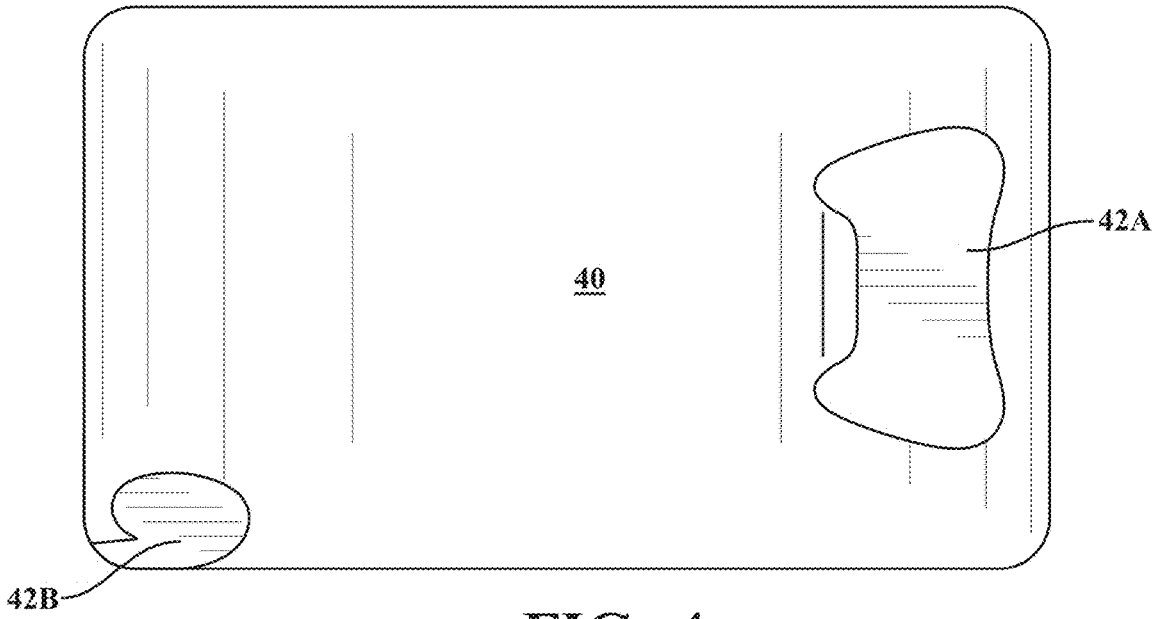
FIG. 4 is a rear view of a utility tool for the hat assembly according to one disclosed non-limiting embodiment.

The removable utility tool 40 may be manufactured of a metal material to provide particular tools such as a bottle opener 42A, a beer shotgun tool 42B (FIG. 4) to quickly and efficiently puncture a beer can to facilitate fast drinking, a practice known as "shot-gunning", and/or other tools formed directedly into the removable utility tool 40.

Figure 6:
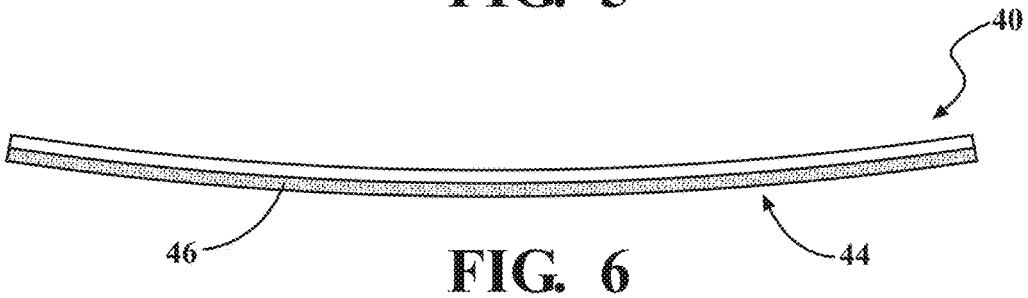
FIG. 6 is a top view of the utility tool for the hat assembly according to one disclosed non-limiting embodiment.

In one embodiment, the removable utility tool 40 is generally rectangular in shape and curved (FIG. 6) to match that of the front panels 34F1, 34F2. That is, the removable utility tool 40 is contoured to match the front of the hat.

Figure 5:
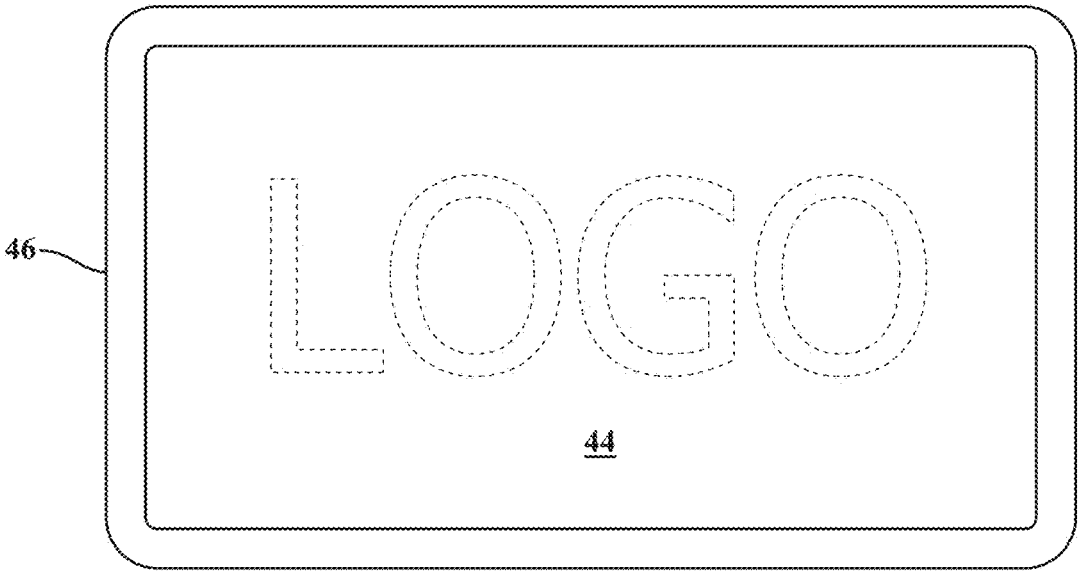
FIG. 5 is a front view of the utility tool for the hat assembly according to one disclosed non-limiting embodiment.

The removable utility tool 40 may include a visible face 44 (FIG. 5) of the removable utility tool 40 that is covered with fabric, leather, metal, or another suitable material. Alternatively, or in addition the visible face 44 can be customized from subtle logos or etched designs of various finishes, colors, and/or metals. Alternatively, or in addition the visible face 44 may include a hook and loop type material 46 (e.g., hook) to provide attachment for a patch that topically includes a complementary hook and loop type material (e.g., loop)

Figure 7:
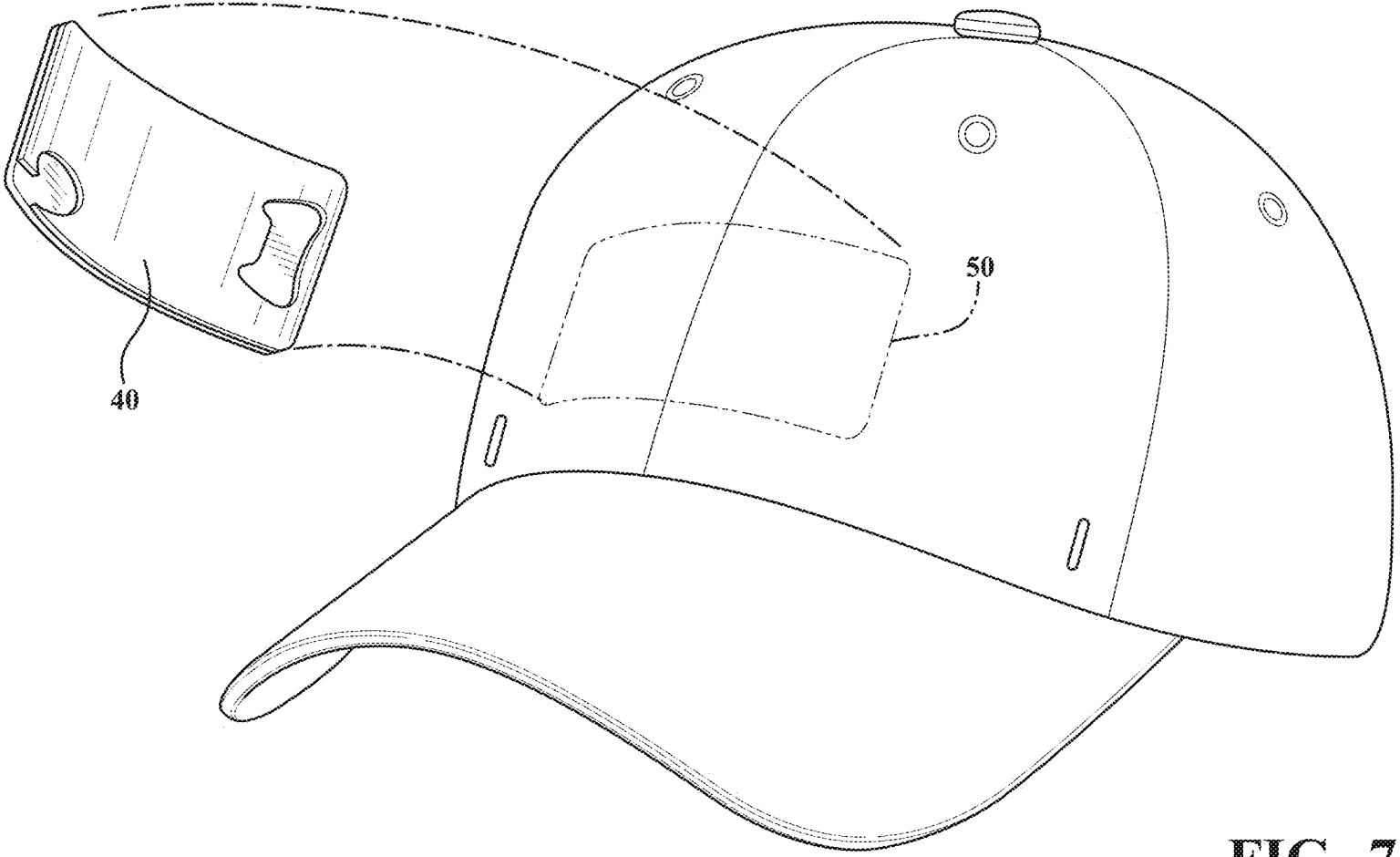
FIG. 7 is an exploded view of the hat assembly.

In one embodiment, the front panels 34F1, 34F2 includes an attachment 50 (FIG. 7) such as a magnet that removably secures the utility tool 40. That is, the utility tool 40 is of a metal material such as steel that is attachable to the attachment 50. In embodiments, the attachment 50 is encased in the front panels 34F1, 34F2 such that it is not otherwise visible when the removable utility tool 40 is not attached.

In other embodiments, a low-profile internal pocket 60 is located on the interior of the front panels 34F1, 34F2 adjacent to the attachment 50 (FIG. 2). The low-profile internal pocket 60 may be sized to store small items such as an identification (ID), credit card, cash, etc., and include a closure such as a zipper 62, etc.

With reference to FIG. 2, in other embodiments, slits 70 in the front panel 34F and the back panel 34B are arranged along parallel axes P1 P2 to receive temples of sunglass to provide a convenient, hands-free solution for storing sunglasses when not in use. Additionally, these slits 70 can be used for other purposes, such as holding pencils, golf tees, small tools, etc. Rubber flaps or inserts may be incorporated within or adjacent to the slits 70 to enhance retention and prevent items from slipping out during movement.

The hat assembly 20 may be manufactured from breathable materials and designed for all-day comfort to provide for an everyday carry solution.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed:

1. A hat assembly, comprising:

a cap having a first front panel, a second front panel, a first back panel and a second back panel;

a removable utility tool comprises a bottle opener, wherein a visible front face of the removable utility tool comprises a hook and loop material;

a magnet attached to the first and second front panels, the magnet attachable to a rear face of the removable utility tool;

a first front slot in the first front panel and a first back slot in the first back panel arranged along a parallel axis; and;

a second front slot in the second front panel and a second back slot in the second back panel arranged along a parallel axis, the first front slot, the first back slot, the second front slot, and the second back slot arranged to receive temples of a pair of glasses.

2. The hat assembly as recited in claim 1, wherein the removable utility tool comprises a beer shotgun tool.

3. The hat assembly as recited in claim 1, wherein the hat comprises a baseball hat.

4. The hat assembly as recited in claim 1, wherein the removable utility tool comprises a curved rectangular metallic component with the bottle opener formed in the curved rectangular component.

5. The hat assembly as recited in claim 1 further comprising a pocket extending across an interior surface of the first and the second front panels.

6. A baseball hat assembly, comprising:

a cap having a first front panel a second front panel, a first back panel and a second back panel;

a magnet attached to the first and the second front panels;

a removable utility tool shaped to match a curvature of the first and the second front panels, the removable utility tool magnetically attachable to the magnet, wherein the removable utility tool comprises a bottle opener and a beer shotgun tool, wherein a visible face of the removable utility tool comprises a hook and loop material;

a zippered pocket extending across an interior surface of the first and the second front panels adjacent to the magnet such that the zippered pocket is hidden when worn by a user.

7. The hat assembly as recited in claim 6, further comprising a first front slot in the first front panel and a first back slot in the first back panel arranged along a parallel axis and a second front slot in the second front panel and a second back slot in the second back panel arranged along a parallel axis, the first front slot, the first back slot, the second front slot, and the second back slot arranged to receive temples of a pair of glasses.

8. A hat assembly, comprising:

a cap having a first front panel a second front panel, a first back panel and a second back panel;

a magnet attached to the first and the second front panels;

a removable utility tool shaped to match a curvature of the first and the second front panels, the removable utility tool magnetically attachable to the magnet, wherein the removable utility tool comprises a bottle opener and a beer shotgun tool, a visible face of the removable utility tool comprises a hook and loop material;

a zippered pocket extending across an interior surface of the first and the second front panel adjacent to the magnet such that the zippered pocket is hidden when worn by a user;

a first front slot in the first front panel and a first back slot in the first back panel arranged along a parallel axis; and a second front slot in the second front panel and a second back slot in the second back panel arranged along a parallel axis, the first front slot, the first back slot, the second front slot, and the second back slot arranged to receive temples of a pair of glasses.

* * * * *